US006286157B1

(12) United States Patent
Baumann

(10) Patent No.: US 6,286,157 B1
(45) Date of Patent: Sep. 11, 2001

(54) INFLATABLE COVER FOR SWIMMING POOLS

(75) Inventor: Brian Baumann, 1018 Fairway Rd., Franklin Square, NY (US) 11010

(73) Assignee: Brian Baumann, Franklin Sq., NY (US)

( * ) Notice: Subject to any disclaimer, the term of this patent is extended or adjusted under 35 U.S.C. 154(b) by 0 days.

(21) Appl. No.: 09/552,057

(22) Filed: Apr. 19, 2000

(51) Int. Cl.[7] ..... E04H 4/00
(52) U.S. Cl. ..... 4/503; 4/498; 4/499
(58) Field of Search ..... 4/498, 499, 500, 4/502, 503; 220/216

(56) References Cited

U.S. PATENT DOCUMENTS

| | | | | |
|---|---|---|---|---|
| D. 330,087 | | 10/1992 | Mejias | D25/2 |
| 2,888,717 | | 6/1959 | Domitrovic | 4/499 |
| 3,533,110 | * | 10/1970 | Gisondi | 4/499 |
| 3,940,809 | | 3/1976 | Hughes | 4/499 |
| 5,144,704 | * | 9/1992 | Genzel et al. | 4/499 |
| 5,826,283 | * | 10/1998 | Edwards | 4/503 |

* cited by examiner

*Primary Examiner*—Gregory L. Huson
*Assistant Examiner*—Tuan Nguyen

(57) ABSTRACT

An inflatable cover for swimming pools comprising a pliable exterior sheet and a pliable interior sheet permanently affixed to one another around an outer periphery thereof. The exterior sheet includes an air inlet valve, which functions to allow air to be forced into a cavity formed within the exterior sheet and interior sheet for inflating the cover. The exterior sheet is larger in circumference than the interior sheet, allowing the exterior sheet to hang over a perimeter of a swimming pool, and further allowing the exterior sheet to engage a skirt member. The skirt member wraps around the perimeter of the pool and includes a plurality of apertures through which a strap is inserted. The skirt member further comprising a buckle which functions to allow tension of the strap to be adjusted, in total allowing a user to removably affix the inflatable cover to the swimming pool in a tight and secure manner.

11 Claims, 2 Drawing Sheets

INFLATABLE COVER FOR SWIMMING POOLS

BACKGROUND OF THE INVENTION

1. Field of the Invention

The present invention is an inflatable cover for swimming pools. More particularly, the present invention consists of two large elliptical sheets fused or sewn to one another, with an air inlet valve located on an exterior surface thereof. This allows one to force air into the cavity formed within the two sheets to inflate the pool cover. The top sheet is intended to be larger in circumference than the bottom sheet, allowing the top sheet to hang over the perimeter of the pool. This enables the top sheet to engage a skirt member, which wraps around the perimeter of the pool, for the purposes of secure connection to the pool. Specifically, the skirt comprises a plurality of apertures, preferably in the form of button hole type slits through which a strap is inserted. The tension of the strap may be adjusted by a buckle, allowing the user to tightly secure the cover to the pool.

2. Description of the Prior Art

Many innovations for pool covers and inflatable members have been provided in the prior art, described as follows. Although these inventions are suitable for the purposes they address, they differ from the present invention as contrasted herein. Following is a summary of patents most relevant to the invention at hand, including description of differences between features of the invention and those of the prior art.

U.S. Pat. No. D330,087, Invented by Mejias, Jr., Entitled "Pool Cover"

The Mejias patent features an ornamental design for a pool cover, as shown and described.

U.S. Pat. No. 2,888,717, Invented by Domitrovic, Entitled "Silo Sealing Cover"

The Domitrovic invention is a weighted sealing device which rests upon the contents of a silo and effectively seals the contents from the surrounding atmosphere. The cover is constructed of rubber or rubber coated canvas, and includes a valve for the inlet of water. Further, the device teaches a flexible and inflatable chamber and a ring-like member to provide for free peripheral exterior expansion.

U.S. Pat. No. 3,940,809, Invented by Hughes, Entitled "Swimming Pool Cover"

In the Hughes patent, a hollow air filled flexible horizontal endless plastic waterproof loop floats on top of the water in a swimming pool and is shaped to conform with and bear continuously against the inner periphery of the pool. The loop has an open central region. A thin flat flexible horizontal plastic waterproof sheet is disposed in the region to close same and is sealed at its periphery to the loop.

As outlined above, prior art patents relating to the present invention show the usage of pool covers that allow for openings in the center portion of the annulus formed, pool covers that teach the usage of removable plugs, and inflatable silo covers that are designed to block contents from heat and moisture.

In contrast to the above, the present invention is an inflatable cover for swimming pools with two large elliptical sheets affixed to one another, with an air inlet valve located on an exterior surface thereof, allowing one to force air into the cavity formed within the sheets to inflate the cover. Unlike in the prior art, the top sheet is larger in circumference than the bottom sheet, allowing the same to hang over the perimeter of the pool and engage a skirt member, which wraps around the perimeter for secure connection to the pool.

SUMMARY OF THE INVENTION

As noted, the present invention is an inflatable pool cover featuring unique securement means. According to the foregoing, it is a principal object of the present invention to provide an effective way for a user to cover a swimming pool, one that is extremely convenient to install and remove.

As such, it is a further object of the present invention to provide an assembly that dispenses with the need for a conventional bubble located beneath a traditional pool cover.

It is another object of the present invention to eliminate the need for two separate cover members, reducing the overall cost of the item in question.

It is also an object of the present invention to provide a stronger, more secure pool cover, as a broken or ruptured bubble used in a traditional pool cover often leads to sinking of the same, creating a danger for children, pets, and objects falling on the pool.

It is an object of the present invention to provide a cover that can more effectively withstand the falling of rain, snow, ice, sleet, hail, leaves, and branches thereon, as the cover will simply allow such elements to roll off to its sides.

It is a particular object of the present invention to provide a unique arrangement that allows a single user to inflate and install the cover atop a pool, dispensing with the need for multiple persons to lift or secure the same.

Finally, it is the intention of the present invention to provide an inflatable cover that may be adapted for effective usage on above ground or in ground pools, or substantially any shape and size.

In total, the novel features considered characteristic for the invention are set forth in the claims. The invention itself both as to its construction and method of operation, will be best understood from the following description of the embodiments when read and understood in connection with the drawings provided.

BRIEF DESCRIPTION OF PREFERRED EMBODIMENTS

DETAILED DESCRIPTION OF THE PREFERRED EMBODIMENT

As noted, the present invention is an inflatable cover for swimming pools. More particularly, the present invention consists of two large elliptical sheets fused or sewn to one another, and measured to fit securely within the interior of the pool in question, whether the pool is round, oval, or rectangular in nature. The sheets constructed of a polyethylene type material in the preferred mode—a material that is relatively inexpensive, pliable, and easy for one to work with.

Figure 1:
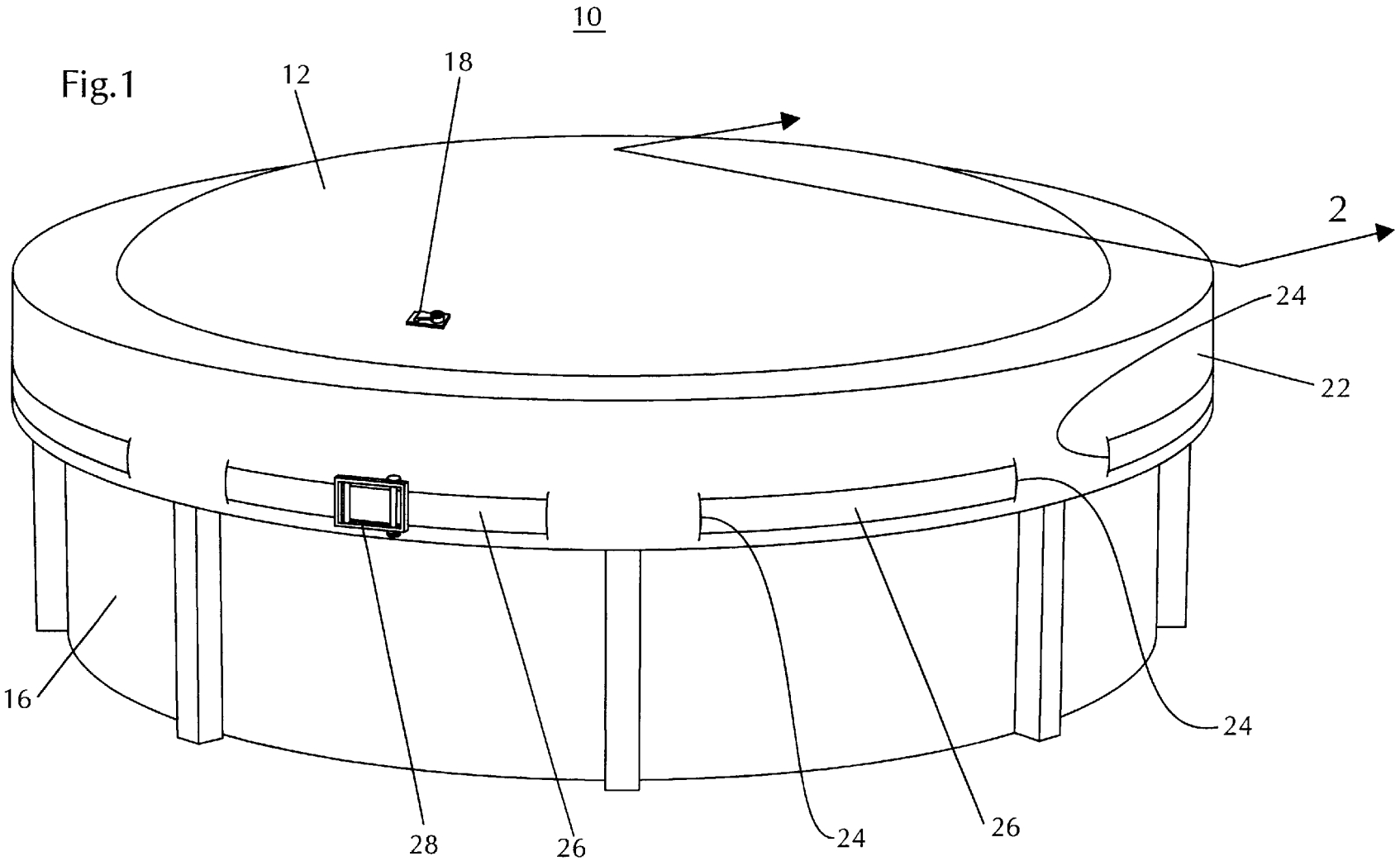
FIG. 1 is a three-quarter perspective view of the inflatable cover for swimming pools, illustrating the exterior sheet around the periphery of a swimming pool, and further illustrating skirt member with preferred fastening means.
Figure 2:
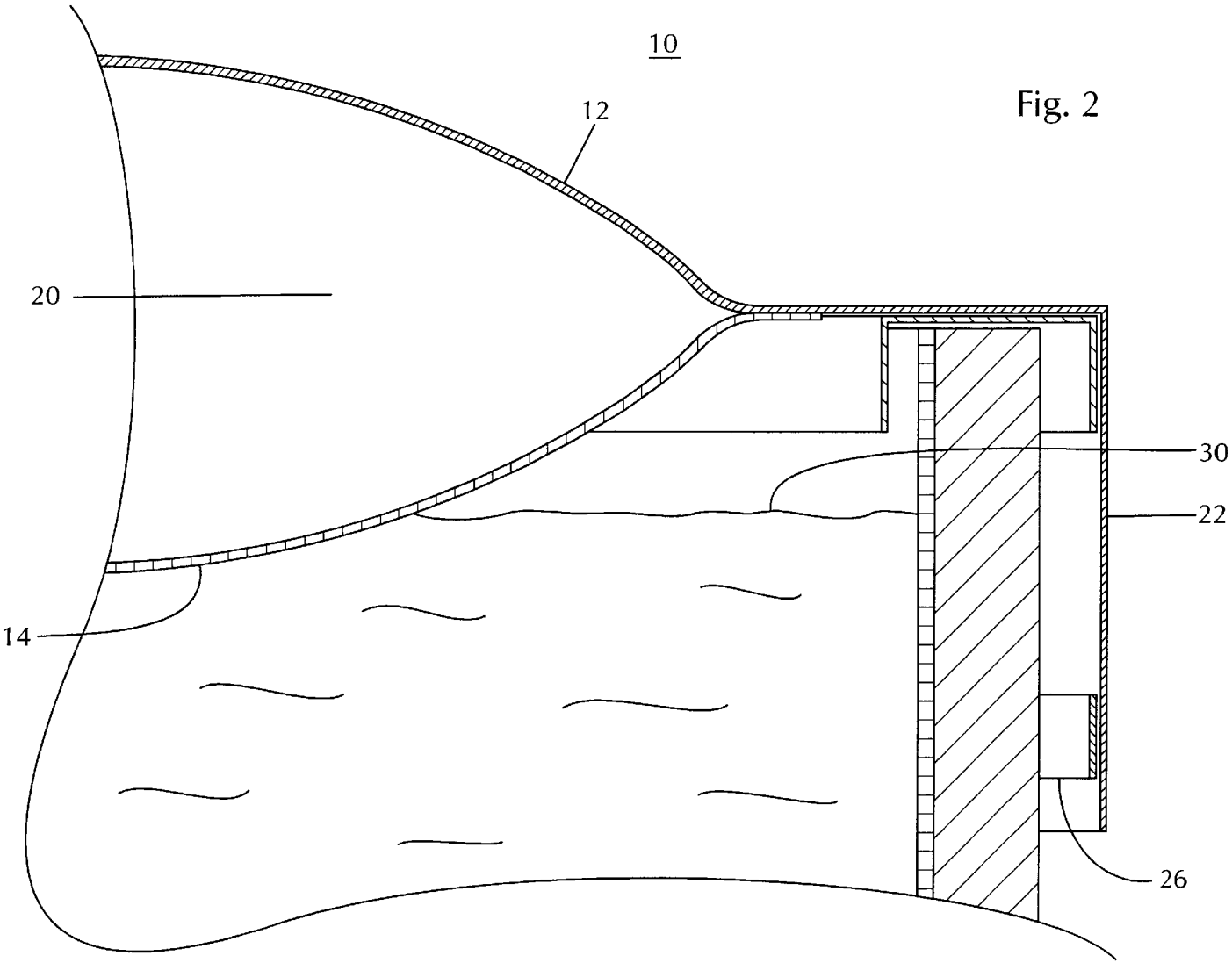
FIG. 2 is a cut-away view of the inflatable cover for swimming pools, illustrating the interior sheet, exterior sheet, and outer edge of swimming pool.

Referring to both FIG. 1, which is a three-quarter perspective view of the inflatable cover for swimming pools, illustrating the exterior sheet around the periphery of a swimming pool, and further illustrating skirt member with preferred fastening means, and FIG. 2, which is a cutaway view of the inflatable cover for swimming pools, illustrating the interior sheet, exterior sheet, and outer edge of swimming pool, the device (10) further comprises an air inlet valve (18) located on an exterior surface (12) thereof, the inlet valve (18) allowing one to force air into the cavity formed within the two fused sheets (20) for the purpose of inflating the pool cover (10). Such air entry may be through usage of a pump, blower, or other suitable device.

Importantly, the exterior, or top sheet (12) is intended to be larger in circumference than the interior, or bottom sheet (14), so as to allow the exterior sheet (12) to hang over the outer perimeter of the pool being covered (16). This enables the exterior sheet (12) to engage a skirt member (22), which descends from the top sheet (12) and wraps around the upper portion of the outer perimeter of the pool (16), for the purposes of secure connection of the cover (10) to the pool (16).

Specifically, the skirt (22) comprises a plurality of equidistantly oriented apertures (24) around its perimeter, such apertures (24) preferably in the form of button hole type slits. In the preferred mode, a simple one-inch diameter nylon strap (26) is inserted into each of the skirt apertures (24), and engages a fastening means (28) in at least one location in the assembly. Such fastening means (28) may be in the form of a rachet-type buckle, allowing the tension of the cover (10) to be adjusted by the user.

In the preferred mode of production, the exterior member (12) is approximately three feet larger in diameter than the interior member (14), in order to allow for the exterior member (12) to engage a skirt (22) of a width of approximately eighteen inches. The height of the inflated cover (10) is approximately eighteen inches above the top rail of the swimming pool (16), or approximately three feet above the water level (30) therein.

Regarding the means to install and remove the cover (10), such may be removed from a carton or other packaging means by simple rolling out upon a flat surface, such as a lawn. Such rolling similarly allows the device (10) to be easily stored during periods of non-usage. The user then locates the air inlet valve (18), which may be accordingly marked by colors, text, or graphics for easy placement.

As noted, the user inflates the cover (10) utilizing an item such as a blower hose of a vacuum cleaner, an air pump, a hair dryer, or any other effective item. Once inflated, the device (10) can then be easily moved by a single user and placed atop the filled swimming pool (16). In the case of inground pools, which must be covered due to their dangerous nature, the cover (10) will be very easy for the user to set in place, due to its position below the surface However, because the cover of the present invention (10) is substantially light in weight, the user can also raise the same over an above-ground pool (16) without much difficulty.

Because the exterior sheet of polyethylene (12) is larger in circumference that its corresponding inner member (14), the user may simply grasp the exterior or top sheet (12) and drape it over the outer edge of the pool (16), allowing the skirt (22) to descend around the outer edge of the pool (16) for subsequent securement. The user inserts the rope (26) through the apertures (24) upon the skirt (22) and buckles the same to itself at the level of tension desired by the user.

It is important to note, with regards to maintenance, that the cover of the present invention (10) need not be drained at the end of each winter, as debris simply rolls off the sides of the cover. Due to such rolling, the cover (10) can be expected to enjoy a life expectancy of three to five times greater than that of traditional pool covers. Such will greatly mitigate the detriments of having to maintain a pool on a year-round basis, enabling more persons to have pools installed and allowing those already possessing pools to use them for many years without hesitation.

While the invention has been described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. An inflatable cover measured to securely fit within a perimeter of a swimming pool comprising:

a pliable polyethylene exterior sheet and a pliable polyethylene interior sheet permanently affixed to one another around an outer periphery thereof;

the pliable exterior sheet comprising an air inlet valve, which functions to allow air to be forced into a cavity formed within the exterior sheet and interior sheet for the purpose of inflating the cover, location of the air inlet valve visibly marked by indicia;

the exterior sheet larger in circumference than the interior sheet, allowing the exterior sheet to hang over a perimeter of the swimming pool, and further allowing the exterior sheet to engage a skirt member, the skirt member wrapping around the perimeter of the pool and comprising a plurality of equidistantly spaced strap loops through which a nylon strap is inserted, each strap loop is formed by a set of apertures, the plurality of strap loops being equidistantly spaced around the perimeter of the pool for allowing the nylon strap to extend through the strap loops and secure the skirt member around the perimeter of the pool;

the skirt member further comprising a buckle which functions to allow tension of the strap to be adjusted, allowing a user to removably affix the inflatable cover to the swimming pool in a tight and secure manner.

2. The inflatable cover for swimming pools as described in claim 1, wherein the cover is of a shape selected from the group consisting of round, oval, square, and rectangular.

3. The inflatable cover for swimming pools as described in claim 1, wherein the apertures are sixth inches apart from one another.

4. The inflatable cover for swimming pools as described in claim 1, wherein the skirt member is of a width of eighteen inches.

5. The inflatable cover for swimming pools as described in claim 1, wherein an upper surface of the cover lies eighteen inches above an upper edge of the swimming pool.

6. The inflatable cover for swimming pools as described in claim 1, wherein an upper surface of the cover lies three feet above a water level of the swimming pool.

7. The inflatable cover for swimming pools as described in claim 1, wherein the cover is adapted to be inflated through usage of an item selected from the group consisting of a hair dyer, air pump, and vacuum hose.

8. The inflatable cover for swimming pools as described in claim 1, wherein the exterior sheet is approximately three feet larger than the interior sheet in diameter.

9. The inflatable cover for swimming pools as described in claim 1, wherein the strap inserted within the apertures of the skirt member is approximately one inch in width.

10. The inflatable cover for swimming pools as described in claim 1, wherein the apertures upon the skirt member are in the form of button hole type slits.

11. The inflatable cover for swimming pools as described in claim 1, wherein a fastening means utilized is a rachet-type buckle.

* * * * *